US006244058B1

(12) United States Patent
Duga et al.

(10) Patent No.: US 6,244,058 B1
(45) Date of Patent: Jun. 12, 2001

(54) TUBE AND SHELL EVAPORATOR OPERABLE AT NEAR FREEZING

(75) Inventors: Joel S. Duga, Onalaska, WI (US); Steven J. Pitts, LaCrescent, MN (US); John H. Roberts, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 09/489,203

(22) Filed: Jan. 21, 2000

(51) Int. Cl.[7] ..... F25D 17/00
(52) U.S. Cl. ..... 62/177; 62/435
(58) Field of Search ..... 62/177, 430, 434, 62/435

(56) References Cited

U.S. PATENT DOCUMENTS

| | | | | |
|---|---|---|---|---|
| 4,387,368 | | 6/1983 | Day, III et al. . | |
| 5,083,438 | | 1/1992 | McMullin . | |
| 5,355,691 | * | 10/1994 | Sullivan et al. | 62/201 |
| 5,392,612 | | 2/1995 | Alsenz . | |
| 5,435,155 | * | 7/1995 | Paradis | 62/515 |
| 5,491,982 | * | 2/1996 | Gowens | 62/434 |
| 5,706,883 | * | 1/1998 | Ward | 62/436 |
| 5,782,131 | | 7/1998 | Lord et al. . | |
| 5,894,739 | * | 4/1999 | Temos | 62/436 |

OTHER PUBLICATIONS

"*The Air Conditioning, Heating and Refrigeration News*", Nov. 3, 1997, "New chillers offer flexibitliy and efficiency for replacement application", p. 14, Business News Publishing Co.

* cited by examiner

*Primary Examiner*—Michael Buiz
*Assistant Examiner*—Mohammad M Ali
(74) *Attorney, Agent, or Firm*—William J. Beres; William O'Driscoll; Peter D. Ferguson

(57) ABSTRACT

A tube and shell evaporator operable at near freezing includes a temperature sensor that senses the temperature of chilled water discharging from one or just a few of the very coldest tubes, whereby the sensed temperature is less than the average leaving chiller water temperature (LCWT). The result provides an exceptionally low LCWT, which can be especially desirable in district cooling systems where the chilled water is usually piped a great distance.

23 Claims, 1 Drawing Sheet

TUBE AND SHELL EVAPORATOR OPERABLE AT NEAR FREEZING

BACKGROUND OF THE INVENTION

1. Field of the Invention

The subject invention generally pertains to tube and shell heat exchangers and more specifically to an evaporator that provides a chiller water temperature marginally above freezing.

2. Description of Related Art

Many chiller systems include a closed loop refrigerant circuit comprising a compressor, a condenser, a flow restriction, and an evaporator. Expanded, cold refrigerant in the evaporator cools a secondary closed loop chilled fluid circuit. The chilled fluid, such as water or a water-based solution, is distributed to and circulated through various smaller heat exchangers. The smaller heat exchangers cool various comfort zones, such as rooms or other areas within a building.

In many cases, one or more chillers are dedicated to a single building. However, in some cases one large central cooling system, comprising one or more chillers, serve several distinct buildings. The chilled water is typically piped a great distance to reach the various buildings. Such a chiller system is often referred to as a "district cooling system."

As chilled water is conveyed through a relatively long network of pipes, the water takes on heat before reaching its various designated heat exchangers. To ensure that the chilled water is sufficiently cold upon reaching the heat exchangers, it is usually desirable to have the evaporator reduce the temperature of the water as much as possible. However, if the water gets too cold, it may freeze inside the evaporator. Freezing, of course, can destroy the evaporator and/or its associated piping.

To avoid freeze up, the chilled water solution may be a glycol and water solution or some other solution having a lower freezing point than pure water. However, with district cooling systems, an appreciable amount of glycol or other solution that may lower the freezing point can be rather costly due to the large volume contained within the chilled water piping that interconnects the evaporator and the remote heat exchangers. Consequently, current district cooling systems use water solutions that consist of primarily water with perhaps small amounts of water treatment chemicals. Since such solutions have a freezing point near 32 degrees Fahrenheit, evaporators are typically operated at a temperature safely above that.

To this end, many chillers control the leaving chiller water temperature (LCWT) in response to a temperature sensor installed immediately downstream of the evaporator or situated within an outlet water box of the evaporator (see U.S. Pat. Nos. 5,083,438 and 5,355,691). The outlet water box serves as somewhat of a manifold or collection point into which the numerous heat exchange tubes within the evaporator shell discharge. The temperature sensor, whether in the water box or immediately downstream of the evaporator, usually provides a generally good indication of the LCWT.

However, the sensed temperature is only an average of the actual water temperature discharging from each individual tube of the evaporator. In a tube and shell heat exchanger the discharge temperature at each tube often varies from one tube to the next, depending on its location within the shell and the conditions under which the system is operating.

Thus, to avoid freeze up at any individual tube, chillers are usually controlled to provide an average LCWT that is well above freezing, typically 37 degrees Fahrenheit or higher.

Unfortunately, when leaving the evaporator at 37 degrees, the chiller water temperature may rise to an unacceptable high temperature by the time it reaches the remote heat exchangers of a district cooling system.

In some chiller systems, such as the one disclosed in U.S. Pat. No. 5,782,131, a temperature sensor senses the temperature of the refrigerant inside an evaporator, as opposed to directly sensing the temperature of the chilled water. However, with such a system it may be difficult to determine what minimum allowable refrigerant temperature still avoids freezing the water. For example, in some cases, a refrigerant temperature of 30 degrees might only be able to chill the water to 38 degrees Fahrenheit.

SUMMARY OF THE INVENTION

To minimize the LCWT of a tube and shell evaporator, it is an object of the invention to monitor the temperature of the chiller water discharging from generally one or just a few of the very coldest tubes, as opposed to just sensing the average LCWT.

Another object is to control the operation of a chiller system in response to feedback from a temperature sensor that senses the temperature of the chiller water discharging from one or just a few of the very coldest tubes, as opposed to just sensing the average LCWT.

Another object is to maintain the temperature of the chiller water discharging from one or just a few of the very coldest tubes to a temperature of no more than 36 degrees Fahrenheit.

For chiller systems operating from part load to full load, another object is monitor the chiller water temperature at a location between the coldest tube at part load and the coldest tube at full load.

For chiller systems subject to refrigerant loss, another object is to monitor the chiller water temperature near the coldest tube during a normal operating condition as well as during a condition of low refrigerant charge.

In some embodiments, another object of the invention is to monitor the chiller water temperature at an elevation within the upper third of the tube bundle, where the refrigerant tends to boil most dramatically.

In some embodiments, further object of the invention is to monitor the chiller water temperature just below the top row of tubes to avoid sensing at an elevation where the refrigerant is in a primarily gaseous state.

In some embodiments, a still further object is to monitor the chiller water temperature at about the third row of tubes from the top where the refrigerant is a mixture of both liquid and gaseous refrigerant.

Another object is to monitor both the average LCWT and the temperature of the chiller water discharging from one or just a few of the very coldest tubes, whereby the average LCWT provides an indicator of the chiller system's overall operating performance, while the monitoring the coldest water temperature provides feedback that helps in optimizing that performance.

Another object is to monitor the refrigerant temperature within the evaporator in addition to monitoring the temperature of the chiller water discharging from one or just a few of the very coldest tubes, whereby the refrigerant temperature can be lowered well below 32 degrees Fahrenheit without significant risk of freezing.

These and other objects of the invention are provided by a tube and shell evaporator that includes a temperature sensor that senses the temperature of chiller water discharging from one or just a few of the very coldest tubes, whereby the sensed temperature is less than the average leaving chiller water temperature.

The present invention provides an evaporator that uses a refrigerant to chill a water solution. The evaporator comprises a housing defining an inlet water chamber, an outlet water chamber, and a refrigerant chamber; and a plurality of tubes each of which have an exterior surface exposed to the refrigerant chamber and an interior surface adapted to convey said water solution from the inlet water chamber to the outlet water chamber. The plurality of tubes are adapted to transfer heat from the water solution to the refrigerant to provide an average leaving chiller water temperature within said outlet water chamber. A first tube of the plurality of tubes is disposed at a higher elevation than a second tube of the plurality of tubes. The first tube and the second tube are adapted to convey the water solution at a first temperature and a second temperature respectively. The first temperature is less than the second temperature and is less than the average leaving chiller water temperature. A temperature sensor is situated closer to the first tube than the second tube and is adapted to sense a water solution temperature that is less than the second temperature and less than the average leaving chiller water temperature.

The present invention also provides a chiller system that uses a refrigerant to chill a water solution. The chiller system comprises a compressor adapted to provide a variable output of the refrigerant; a condenser adapted to receive refrigerant discharged from the compressor; a flow restriction adapted to receive refrigerant discharged from the condenser and adapted to create a pressure and temperature drop upon the refrigerant passing through the flow restriction; an evaporator defining an inlet water chamber, an outlet water chamber, and a refrigerant chamber wherein the refrigerant chamber is adapted to receive refrigerant discharged from the flow restriction and discharge the refrigerant back to the compressor; and a plurality of tubes each of which have an exterior surface exposed to the refrigerant chamber and an interior surface adapted to convey the water solution from the inlet water chamber to the outlet water chamber. The plurality of tubes are adapted to transfer heat from the water solution to the refrigerant to provide an average leaving chiller water temperature within the outlet water chamber. A first tube of the plurality of tubes is disposed at a higher elevation than a second tube of the plurality of tubes. The first tube and the second tube are adapted to convey the water solution at a first temperature and a second temperature respectively, where the first temperature is less than the second temperature and less than the average leaving chiller water temperature. A temperature sensor is situated closer to the first tube than the second tube and is adapted to sense a water solution temperature that is less than the second temperature and less than the average leaving chiller water temperature.

The present invention further provides a chiller system that uses a refrigerant to chill a water solution. The chiller system comprises a compressor adapted to compress the refrigerant selectively at a full load condition and a partial load condition; a condenser adapted to receive refrigerant discharged from the compressor; a flow restriction adapted to receive refrigerant discharged from the condenser and adapted to crate a pressure and temperature drop upon the refrigerant passing through said flow restriction; an evaporator defining an inlet water chamber, an outlet water chamber, and a refrigerant chamber, where the refrigerant chamber is adapted to receive refrigerant discharged from the flow restriction and discharge the refrigerant back to the compressor; and a plurality of tubes each having an inlet end exposed to the inlet water chamber, an outlet end exposed to the outlet water chamber, and an exterior surface exposed to the refrigerant chamber. the refrigerant is adapted to cool the water solution upon the water solution passing through the plurality of tubes from the inlet water chamber to the outlet water chamber to create an average leaving chiller water temperature within the outlet water chamber. The chiller system creates a first minimum water temperature at a first outlet end of the plurality of tubes at a full load condition and creates a second minimum water temperature at a second outlet end of the plurality of tubes at a partial load condition. The first outlet end is at a higher elevation than the second outlet end. A temperature sensor disposed at an intermediate elevation between that of the first outlet end and the second outlet end and being sufficiently close the plurality of tubes to sense a water solution temperature that is less than the average leaving chiller water temperature.

The present invention additionally provides a method of preventing fluid freeze up in a chiller system. The method comprises the steps of: locating a temperature sensor in an upper third of an evaporator tube bundle; using the temperature sensor to determine the coldest temperature in the evaporator tube bundle; and controlling the operation of the chiller to prevent a fluid being chilled by the chiller from freezing.

DESCRIPTION OF THE PREFERRED EMBODIMENT

Figure 1:
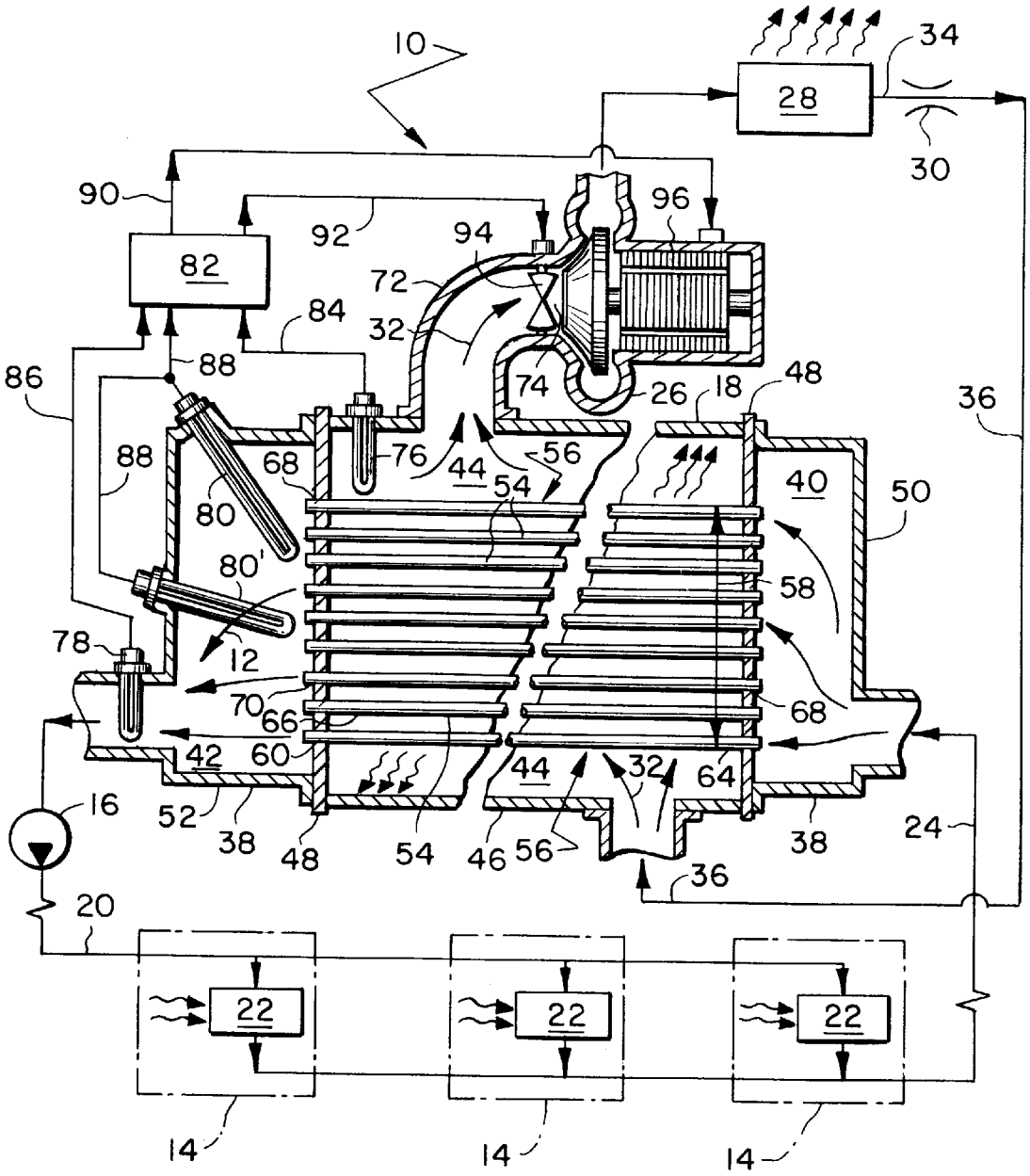
FIG. 1 is a schematic view of a refrigerant chiller system in a distinct cooling application.

Referring to FIG. 1, a refrigerant chiller system 10 in a district cooling application provides chilled water 12 for meeting the cooling demand of several remote buildings 14. A pump 16 draws chilled water 12 provided by a tube and shell evaporator 18 of chiller 10 and discharges the water solution through a rather long supply line 20. Supply line 20 could be a single line or a network of pipes extending up to a mile or more to distribute chilled water 12 to several heat exchangers 22 associated with buildings 14. After circulating through heat exchangers 22 to cool rooms or areas within buildings 14, water 12 returns to evaporator 18 by way of a return line 24. Although water solution 12 is primarily water in a preferred embodiment, the term, "water solution" actually encompasses any liquid, including but not limited to pure water, chemically treated water, glycol, and various mixtures thereof.

To cool water 12, chiller system 10 includes a hermetically sealed, closed loop refrigerant circuit comprising a refrigerant compressor 26 (e.g., centrifugal, screw, scroll, or reciprocating), a condenser 28 (preferably a tube and shell heat exchanger), a flow restriction 30 (e.g., one or more orifices, or an expansion valve), and evaporator 18. Compressor 26 discharges pressurized refrigerant 32 (e.g., R123) into condenser 28, which cools refrigerant 32 by way of a secondary fluid such as water and/or ambient air. Refrigerant 32 leaves condenser 28 through a line 34 and decreases in pressure and temperature upon passing through restriction 30. Refrigerant 32, now cooler, passes through a line 36 to enter evaporator 18.

Although the specific structure of evaporator 18 may vary, in the illustrated exemplary embodiment evaporator 18 comprises a housing 38 that contains an inlet water chamber 40, an outlet water chamber 42, and a refrigerant chamber 44. In this example, refrigerant chamber 44 is defined by a generally cylindrical shell 46 interposed between two tube sheets 48. Water chambers 40 and 42 are defined by an inlet water box 50 and an outlet water box 52 being bolted to the face of tube sheets 48. Several heat exchanger tubes 54 are arranged in generally horizontal rows (i.e., each row includes several tubes, one behind the other, as viewed looking into FIG. 1). Tubes 54 are collectively referred to as a tube bundle 56, which extends across a vertical span 58 from a lower most point 60 to upper most point 62. Each tube 54 has an exterior surface 64 exposed to refrigerant chamber 44. And each tube 54 has an interior surface 66 extending between an inlet end 68 of the tube and an outlet end 70 to convey water 12 from inlet water chamber 40 to outlet water chamber 42. Thus, tubes 54 place refrigerant 12 in heat transfer relationship with water 12.

Once refrigerant 32 enters evaporator 18, refrigerant 32 passes across tubes 54 to absorb heat from water solution 12. This often causes refrigerant 32 to boil, while water solution 12 cools. Resulting gaseous refrigerant 12 is drawn back into compressor 86 by way of suction line 72, where a compressing element 74, such as an impeller, recompresses refrigerant 32 to repeat the closed loop refrigeration cycle. Chilled water 12 passing through tubes 54 (from inlet water chamber 40 to outlet water chamber 42) is pumped back to remote heat exchangers 22.

To control and/or monitor the operating performance of chiller system 10, several temperature sensors are employed. For example, a temperature sensor 76 (refrigerant sensor) senses the refrigerant temperature within evaporator 18, and a temperature sensor 78 (LCWT sensor) senses the average leaving chiller water temperature or LCWT. To minimize the LCWT while preventing water 12 from freezing, a temperature sensor 80 (tube sensor) is preferably located where it can sense the lowest water temperature at outlet ends 70. To determine the location at which the water temperature is at a minimum, one might expect that the lowest temperature would be near the bottom of tube bundle 56, since heat rises and heat transfer across a tube is often better from a liquid to a liquid, as opposed to a liquid to a vapor.

However, the surprising and unexpected empirically derived results indicate that the lowest water temperature is often in the upper third of tube bundle 56. This has been found to be true even when the heat transfer at the lowest row of tubes involves liquid refrigerant 32 absorbing heat from liquid water 12, while the heat transfer toward the upper portion of tube bundle 56 involves vaporous refrigerant 32 absorbing heat from liquid water 12.

The exact tube row providing the lowest temperature depends on numerous factors including the output capacity at which chiller system 10 is operating. For example, when chiller 10 is at full load, the boiling rate of the refrigerant within evaporator 18 is rather high. The rapidly boiling refrigerant 32 tends to rise near the upper rows of tube bundle 56, and the lowest water temperature may occur at the highest row. However, under a partial load, the refrigerant boiling rate is lower, and the refrigerant's liquid to vapor transition point tends to be lower than when at full load. This tends to place the lowest water temperature several tube rows below the top row.

For chiller systems operable at varying load, the preferred location for sensor 80 is at an elevation below the tube outlet that provides the lowest water temperature at full load and above the tube outlet that provides the lowest water temperature at a partial load. In some embodiments, the preferred location is one tube diameter below upper most point 62, and more specifically near the third row of tubes from the top of tube bundle 56.

For some chiller systems subject to refrigerant loss, an alternate preferred location for the temperature sensor is approximately at the vertical center of tube bundle 56, as shown by temperature sensor 80'. In other word, sensor 80' is disposed generally midway between uppermost point 68 and lowermost point 60, i.e., within the central third to bundle 56. To illustrate alternate mounting locations, water box 52 is shown having both sensors 80 and 80'. However, actually only one sensor at just one of the preferred locations is normally used. The horizontal location of sensor 80' may be centrally located or may be biased to one side of water box 52. With some chillers, the generally central elevation provides the coolest water temperature during normal operation with a proper amount of refrigerant or charge. That same elevation may also provide the coolest water temperature when there is a loss of refrigerant. With a loss of refrigerant, the level of liquid refrigerant in evaporator 18 drops, which greatly diminishes the refrigerant cooling affect near the top of tube bundle 56. This increases the water temperature near the top of bundle 56 and decreases the water temperature near the bottom. The water temperature near the center of bundle 4 remains the same or changes the least, and thus provides a good indication of the minimum water temperature, regardless of reasonable amounts of refrigerant loss.

To control the operation and various temperatures of chiller system 10, a control unit 82 is electrically connected to receive feedback signals 84 from sensor 76, signal 86 from sensor 78, and signal 88 from sensor 80 or 80'. In response to feedback signals 84, 86, and 88, control unit 82 provides various outputs such as outputs 90 and/or 92. Output 90 controls the opening of inlet guide vanes 94, and output 92 controls the speed of a motor 96 that drives compressing element 74. Varying the output capacity of a chiller by varying the speed of its compressor and/or adjusting the position the compressor's inlet guide vanes are well known to those skilled in the art. Thus, control unit 82 is schematically illustrated to encompass a myriad of control circuits including but not limited to microcomputers, programmable controllers, integrated circuits, discrete circuitry, and various combinations thereof. It should also be appreciated by those skilled in the art, that the number and type of inputs and outputs might vary, depending on the desired operating features of the specific chiller system being controlled.

In a preferred embodiment, control 82 modulates the position of inlet guide vanes 94 to maintain a temperature at tube sensor 80 or 80' that is just marginally above 32 degrees Fahrenheit. This allows the average LCWT, as sensed by sensor 78, to be safely maintained at 36 degrees or lower. Moreover, sensor 80 or 80' being properly positioned allows the refrigerant temperature, as sensed by refrigerant sensor 76, to be safely lowered below 29 degrees and perhaps down to 27 degrees or lower. Thus chiller 10 normally operates in response to feedback 88 from tube sensor 80 or 80', as opposed to feedback 86 from LCWT sensor 78. Also, if the temperature at the tube sensor 80 or 80' drops below 33 degrees or below some other predetermined limit, control 82 shuts down the operation of chiller 10 to prevent feeding the chilled water. In some embodiments, feedback 86 from LCWT sensor 78 is useful in determining the actual output capacity of chiller 10; however, feedback 86 is not necessarily relied upon for modulating the position of inlet guide vanes 94. Although LCWT sensor 78 could shut down the operation of chiller 10 upon sensing a LCWT below a predetermined limit, it is more likely that tube sensor 76 would be first to shut down chiller 10, as the temperature is normally lower at tube sensor 80 or 80' than at LCWT sensor 78.

Although the invention is described with respect to a preferred embodiment and various modifications thereto will be apparent to those skilled in the art. Therefore, the scope of the invention is to be determined by reference to the claims, which follow.

We claim:

1. An evaporator that uses a refrigerant to chill a water solution, comprising:

a housing defining an inlet water chamber, and outlet water chamber, and a refrigerant chamber;

a plurality of tubes each of which have an exterior surface exposed to said refrigerant chamber and an interior surface adapted to convey said water solution from said inlet water chamber to said outlet water chamber, whereby said plurality of tubes are adapted to transfer heat from said water solution to said refrigerant to provide an average leaving chiller water temperature within said outlet water chamber;

a first tube of said plurality of tubes being disposed at a higher elevation than a second tube of said plurality of tubes, said first tube and said second tube being adapted to convey said water solution at a first temperature and a second temperature respectively, wherein said first temperature is less than said second temperature and less than said average leaving chiller water temperature; and a temperature sensor situated closer to said first tube than said second tube and being adapted to sense a water solution temperature that is less than said second temperature and less than said average leaving chiller water temperature.

2. The evaporator of claim 1, wherein said plurality of tubes are distributed across a vertical span extending between an upper most point and a lower most point, and said first tube is disposed generally midway therebetween.

3. The evaporator of claim 1, wherein said plurality of tubes are distributed across a vertical span extending between an upper most point and a lower most point, and said first tube is at least twice as far from said lower most point than said upper most point.

4. The evaporator of claim 3, wherein said first tube has an outer diameter and said first tube is below said upper most point by a distance greater than said outer diameter.

5. The evaporator of claim 4, wherein said plurality of tubes are arranged in a plurality of substantially horizontal rows and said first tube is disposed in a third row from the upper most point.

6. A chiller system that uses a refrigerant to chill a water solution, comprising:

a compressor adapted to provide a variable output of said refrigerant;

a condenser adapted to receive refrigerant discharged from said compressor;

a flow restriction adapted to receive refrigerant discharged from said condenser and adapted to create a pressure and temperature drop upon said refrigerant passing through said flow restriction;

an evaporator defining an inlet water chamber, and outlet water chamber, and a refrigerant chamber, wherein said refrigerant chamber is adapted to receive refrigerant discharged from said flow restriction and discharge said refrigerant back to said compressor;

a plurality of tubes each of which have an exterior surface exposed to said refrigerant chamber and an interior surface adapted to convey said water solution from said inlet water chamber to said outlet water chamber, wherein said plurality of tubes are adapted to transfer heat from said water solution to said refrigerant to provide an average leaving chiller water temperature within said outlet water chamber;

a first tube of said plurality of tubes being disposed at a higher elevation than a second tube of said plurality of tubes, said first tube and said second tube being adapted to convey said water solution at a first temperature and a second temperature respectively, wherein said first temperature is less than said second temperature and less than said average leaving chiller water temperature; and a temperature sensor situated closer to said first tube than said second tube and being adapted to sense a water solution temperature that is less than said second temperature and less than said average leaving chiller water temperature.

7. The chiller system of claim 6, wherein said temperature sensor provides a temperature feedback signal that varies with said water solution temperature, and wherein said variable output of said refrigerant is at least partially determined by said temperature feedback signal.

8. The evaporator of claim 6, wherein said plurality of tubes are distributed across a vertical span extending between an upper most point and a lower most point, and said first tube is disposed generally midway therebetween.

9. The chiller system of claim 6, wherein said chiller system is selectively operable at a full load condition and a partial load condition, wherein said plurality of tubes each have an outlet end exposed to said outlet water chamber, wherein said chiller space creates a first minimum water temperature at a first outlet end of said plurality of tubes at said full load condition and creates a second minimum water temperature at a second outlet end of said plurality of tubes at said partial load condition, wherein said first outlet end is at a higher elevation than said second outlet end, and wherein said temperature sensor is disposed at an intermediate elevation between that of said first outlet end and said second outlet end.

10. The chiller system of claim 6, wherein under a predetermined normal operating period, said water solution temperature is allowed to remain below 36 degrees Fahrenheit as sensed by said temperature sensor.

11. The chiller system of claim 6, further comprising a second temperature sensor in heat transfer relationship with said water solution and being disposed downstream of said first temperature sensor.

12. The chiller system of claim 6, further comprising a second temperature sensor in heat transfer relationship with said refrigerant when said refrigerant is flowing from said flow restriction and on to a refrigerant outlet of said evaporator, wherein under a predetermined normal operating period, said water solution temperature is allowed to remain below 36 degrees Fahrenheit, as sensed by said temperature sensor, and a refrigerant temperature is allowed to remain below 29 degrees Fahrenheit as sensed by said second temperature sensor.

13. The evaporator of claim 6, wherein said plurality of tubes are distributed across a vertical span extending between an upper most point and a lower most point, and said first tube is at least twice as far from said lower most point than said upper most point.

14. The evaporator of claim 13, wherein said first tube has an outer diameter and said first tube is below said upper most point by a distance greater than said outer diameter.

15. The evaporator of claim 14, wherein said plurality of tubes are arranged in a plurality of substantially horizontal rows and said first tube is disposed in a third row from the upper most point.

16. A chiller system that uses a refrigerant to chill a water solution, comprising:

a compressor adapted to compress said refrigerant selectively at a full load condition and a partial load condition;

a condenser adapted to receive refrigerant discharged from said compressor;

a flow restriction adapted to receive refrigerant discharged from said condenser and adapted to create a pressure and temperature drop upon said refrigerant passing through said flow restriction;

an evaporator defining an inlet water chamber, an outlet water chamber, and a refrigerant chamber, wherein said refrigerant chamber is adapted to receive refrigerant discharged from said flow restriction and discharge said refrigerant back to said compressor;

a plurality of tubes each having an inlet end exposed to said inlet water chamber, an outlet end exposed to said outlet water chamber, and an exterior surface exposed to said refrigerant chamber, said refrigerant being adapted to cool said water solution upon said water solution passing through said plurality of tubes from said inlet water chamber to said outlet water chamber to create an average leaving chiller water temperature within said outlet water chamber, said chiller system creating a first minimum water temperature at a first outlet end of said plurality of tubes at said full load condition and creating a second minimum water temperature at a second outlet end of said plurality of tubes at said partial load condition, wherein said first outlet end is at a higher elevation than said second outlet end; and a temperature sensor disposed at an intermediate elevation between that of said first outlet end and said second outlet end and being sufficiently close to said plurality of tubes to sense a water solution temperature that is less than said average leaving chiller water temperature.

17. The chiller system of claim 16, wherein said temperature sensor provides a temperature feedback signal that varies with said water solution temperature, and wherein said selective operation of said full load condition and said partial load condition are at least partially determined by said temperature feedback signal.

18. The chiller system of claim 16, wherein under a predetermined normal operating period, said water solution temperature is allowed to remain below 36 degrees Fahrenheit as sensed by said temperature sensor.

19. The chiller system of claim 16, further comprising a second temperature sensor in heat transfer relationship with said water solution and being disposed downstream of said first temperature sensor.

20. The chiller system of claim 16, further comprising a second temperature sensor in heat transfer relationship with said refrigerant when said refrigerant is flowing from said flow restriction and on to a refrigerant outlet of said evaporator, wherein under a predetermined normal operating period, said water solution temperature is allowed to remain below 36 degrees Fahrenheit, as sensed by said temperature sensor, and a refrigerant temperature is allowed to remain below 29 degrees Fahrenheit as sensed by said second temperature sensor.

21. The chiller system of claim 16, wherein said plurality of tubes are distributed across a vertical span extending between an upper most point and a lower most point, and said first tube is at least twice as far from said lower most point than said upper most point.

22. The chiller system of claim 21, wherein said first tube has an outer diameter and said first tube is below said upper most point by a distance greater than said outer diameter.

23. The chiller system of claim 22, wherein said plurality of tubes are arranged in a plurality of substantially horizontal rows and said first tube is disposed in a third row from the upper most point.

* * * * *

UNITED STATES PATENT AND TRADEMARK OFFICE

CERTIFICATE OF CORRECTION

PATENT NO. : 6,244,058 B1
APPLICATION NO. : 09/489203
DATED : June 12, 2001
INVENTOR(S) : Joel S. Duga, Steven J. Pitts and John H. Roberts It is certified that error appears in the above-identified patent and that said Letters Patent is hereby corrected as shown below:

In The Specification:

Column 3, Line 65, "crate" should read -- create --.

Column 4, Line 19, after the word "close" insert -- to --.

Column 4, Line 33, "distinct" should read -- district --.

In The Claims:

Claim 13, Column 8, Line 63, "evaporator" should read -- chiller system --.

Claim 14, Column 9, Line 1, "evaporator" should read -- chiller system --.

Claim 15, Column 9, Line 5, "evaporator" should read -- chiller system --.

Signed and Sealed this

Nineteenth Day of February, 2008

JON W. DUDAS
*Director of the United States Patent and Trademark Office*